US007825345B1

(12) United States Patent
Kano

(10) Patent No.: US 7,825,345 B1
(45) Date of Patent: Nov. 2, 2010

(54) REVERSELY MOUNTED TACTILE SWITCH ASSEMBLY AND PRINTED CIRCUIT BOARD THEREWITH

(76) Inventor: Yoshio W. Kano, 2758 W. Cuba Rd., Barrington, IL (US) 60010

( * ) Notice: Subject to any disclaimer, the term of this patent is extended or adjusted under 35 U.S.C. 154(b) by 239 days.

(21) Appl. No.: 12/198,641

(22) Filed: Aug. 26, 2008

(51) Int. Cl.
*H01H 13/14* (2006.01)

(52) U.S. Cl. ..... 200/296; 200/406; 200/330; 200/292

(58) Field of Classification Search ..... 200/314, 200/520, 292, 406
See application file for complete search history.

(56) References Cited

U.S. PATENT DOCUMENTS

| | | | | |
|---|---|---|---|---|
| 412,758 | A | | 10/1889 | Johnston, Jr. |
| 4,331,851 | A | | 5/1982 | Johnson |
| 4,591,951 | A | | 5/1986 | Iwamoto et al. |
| 4,845,319 | A | | 7/1989 | Watkins et al. |
| 5,150,913 | A | | 9/1992 | Hoelzl |
| 5,552,964 | A | * | 9/1996 | Naito ..... 361/781 |
| 5,828,016 | A | | 10/1998 | Grannan et al. |
| 5,999,084 | A | * | 12/1999 | Armstrong ..... 338/114 |
| 6,011,699 | A | | 1/2000 | Murray et al. |
| 6,351,205 | B1 | * | 2/2002 | Armstrong ..... 338/114 |
| 6,643,170 | B2 | | 11/2003 | Huang et al. |
| 7,183,634 | B2 | | 2/2007 | Lee |
| 7,242,085 | B2 | | 7/2007 | Hosoya |
| 2003/0066739 | A1 | | 4/2003 | Rickenbach et al. |
| 2004/0134765 | A1 | | 7/2004 | Sotome |
| 2006/0278515 | A1 | | 12/2006 | Rochon et al. |
| 2008/0036734 | A1 | | 2/2008 | Forsblad et al. |

* cited by examiner

*Primary Examiner*—Renee S Luebke
*Assistant Examiner*—Lisa Klaus
(74) *Attorney, Agent, or Firm*—Matthew R. P. Perrone, Jr.; Brie A. Crawford

(57) ABSTRACT

A reversely mountable tactile switch assembly has a switch housing with switch terminals and an actuator button secured thereto on the same side of the housing, and can be used on a printed circuit board. The resulting printed circuit board provides for smaller units to be used, especially with appliances.

10 Claims, 8 Drawing Sheets

REVERSELY MOUNTED TACTILE SWITCH ASSEMBLY AND PRINTED CIRCUIT BOARD THEREWITH

This invention relates to a printed circuit board with a tactile switch, and more particularly to a reversely mounted tactile switch assembly and a printed circuit board with the reversely mounted tactile switch assembly mounted thereon, which tactile switch assembly is mounted to the printed circuit board in a reverse fashion.

BACKGROUND OF THE INVENTION

On a printed circuit board, a tactile switch is used to activate various functions of the printed circuit board. The structure and mounting of the tactile switch on the printed circuit board play a great part in determining the size of both the printed circuit board and the overall container for the desired product.

Typically, the tactile switch includes a switch housing. Secured to one side of the switch housing are the mounting legs, which provide electrical connection of the tactile switch to the desired circuit. Also on the switch housing, but oppositely disposed from the mounting legs, is the actuator button. This structure requires a certain degree of thickness to any assembly including a printed circuit board having such a tactile switch mounted thereon.

To that end, it is required to have access to the tactile switch in order to carry out the functions of the printed circuit board. Generally, other components are mounted on the printed circuit board. These components include tall components, which are greater in height than the tactile switch, and thereby interfere with access to the tactile switch. For this reason, such access, to a tactile switch in prior art components, is commonly achieved by providing structure on the overall case for the printed circuit board, so that contact with the switch can be made. Long arms must reach through the tall components to provide access to the tactile switch. These long arms increase production time and cost and decrease the life of the system. Therefore, it is very desirable to make such structure as simple as possible. Yet it is still very desirable to have accurate contact with the switch.

If a more reliable switch for a printed circuit board can be developed, while permitting a smaller package for a device which includes the printed circuit board with the switch or switches thereon, great advantages can be obtained. Not only can the package be made in a more simple fashion, the entire unit with the printed circuit board and the switches is more useful and effective. Activation of the switch at the desired time becomes much more reliable.

SUMMARY OF THE INVENTION

Among the many objectives of the present invention is the provision of a tactile switch assembly for a printed circuit board, which is mounted to the printed circuit board in a reverse fashion.

Another objective of the present invention is the provision of a tactile switch assembly, which permits a thinner circuit assembly.

Yet another objective of the present invention is the provision of a printed circuit board with a tactile switch assembly reversely mounted thereon.

Also, an objective of the present invention is the provision of a tactile switch housing, with the switch adjacent to the mounting assembly.

Moreover, an objective of the present invention is the provision of a tactile switch housing, with the switch being easily accessed.

These and other objectives of the invention (which other objectives become clear by consideration of the specification, claims and drawings as a whole) are met by providing a reversely mounted tactile switch assembly having a switch housing with switch terminals and an actuator button secured thereto on the same side of the housing, and a printed circuit board using the same.

BRIEF DESCRIPTION OF DRAWINGS

Throughout the figures of the drawings, where the same part appears in more than one figure of the drawings, the same number is applied thereto.

DESCRIPTION OF THE PREFERRED EMBODIMENTS

Figure 1:
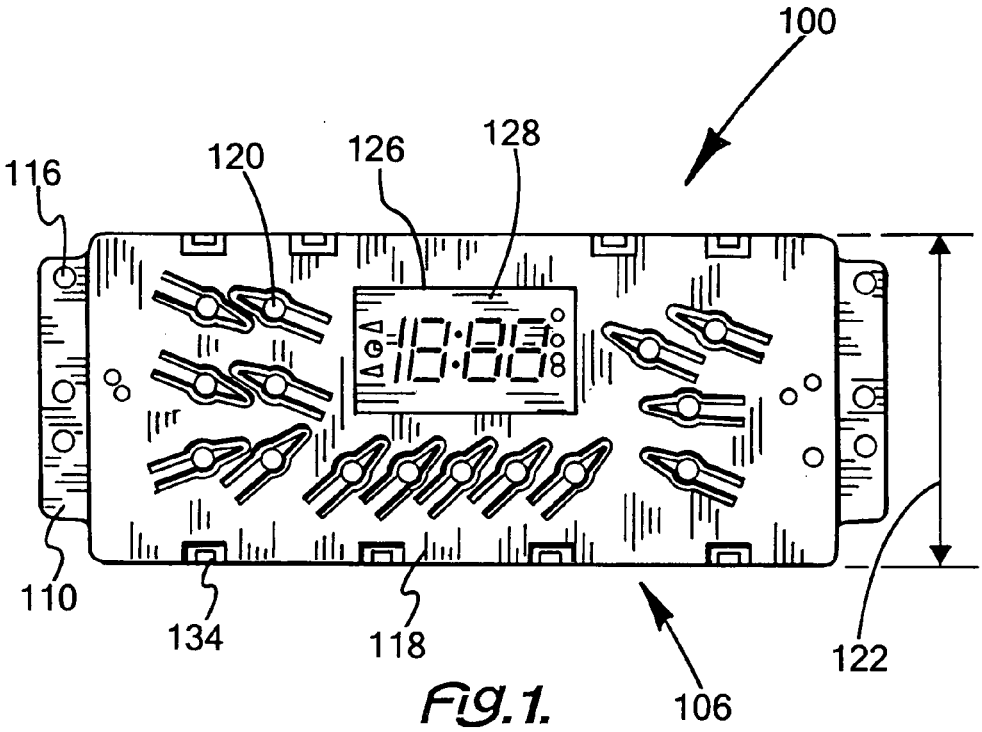
FIG. 1 depicts a top plan view of the reversely mounted tactile switch assembly 100 of this invention in use on a printed circuit board 130 suitable for use with an appliance (not shown).

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, over, above, below, beneath, rear, and front, may be used with respect to the drawings. These and similar to directional terms are not to be construed to limit the scope of the invention in any manner. The words attach, connect, couple, and similar terms with their inflectional morphemes do not necessarily denote direct or intermediate connections, but may also include connections through mediate elements or devices.

The reversely mounted tactile switch assembly of this invention includes a switch housing, with switch terminals and an actuator button. Secured to one side of the switch housing are the switch terminals, which provide electrical connection of the tactile switch assembly to the desired circuit or printed circuit board. Also on the switch housing, and on the same side as the switch terminals, is the actuator button.

This structure greatly reduces the degree of thickness to any assembly including a printed circuit board having such a reversely tactile switch assembly mounted thereon. For example, the actuator button can be directly contacted through an aperture in the printed circuit board. The reversely mounted switches provide a uniform level of the components on the circuit board and eliminate the necessity to maneuver around the tall components.

Figure 2:
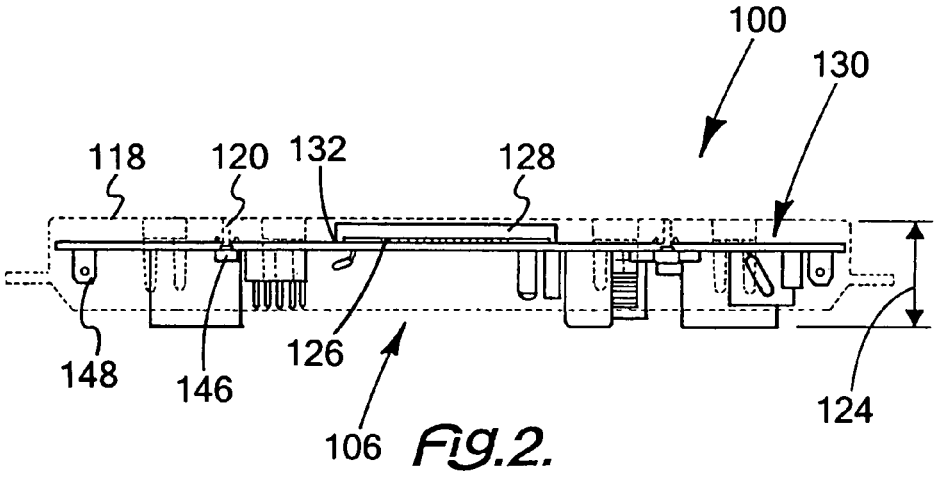
FIG. 2 depicts a side view of the reversely mounted tactile switch assembly 100 of this invention in use on a printed circuit board 130 suitable for use with an appliance (not shown).

Turning now to FIG. 1 and FIG. 2, reversely mounted or mountable tactile switch assembly 100 operates an appliance (not shown), and in particular a printed circuit board 130. Reversely mounted tactile switch assembly 100 is supported in a circuit housing 106. On either side of circuit housing 106, is mounting flange 110. Each mounting flange 110 has at least one flange aperture 116. The flange apertures 116 cooperate with the mounting structure of appliance (not shown) to form a secure and stable attachment. The circuit housing 106 has narrow width 122 and shallow depth 124.

Circuit housing 106 has housing face 118. Housing face 118 has an LED (light-emitting diode) aperture 126, in which is secured flat LED display 128 in place through its alignment and cooperation. Flat LED display 128 has small LED legs 132 to secure it to printed circuit board 130. Flat LED display 128 is smaller than the prior art large LED display 228.

The component side 134 of printed circuit board 130 faces forward toward the rear of appliance (not shown). Housing face 118 also has post aperture 140 through which actuator post 120 inserts. When actuator post 120 is secured in post aperture 140, it can be activated from the face of appliance (not shown).

Circuit housing 106 has a snap fitting 146 which cooperates with printed circuit board 130 to hold it securely within the circuit housing 106. The printed circuit board 130 supports various items to appliance (not shown) to make it operable. Within the circuit housing 106 are actuator posts 120, which with touching or pressure cause the adjacently supported, reversely mounted tactile switch assembly 100 to be activated as mounted on printed circuit board 130. Such structure leads to narrow width 122, and shallow depth 124 for the circuit housing 106 as used on appliance (not shown).

Figure 3:
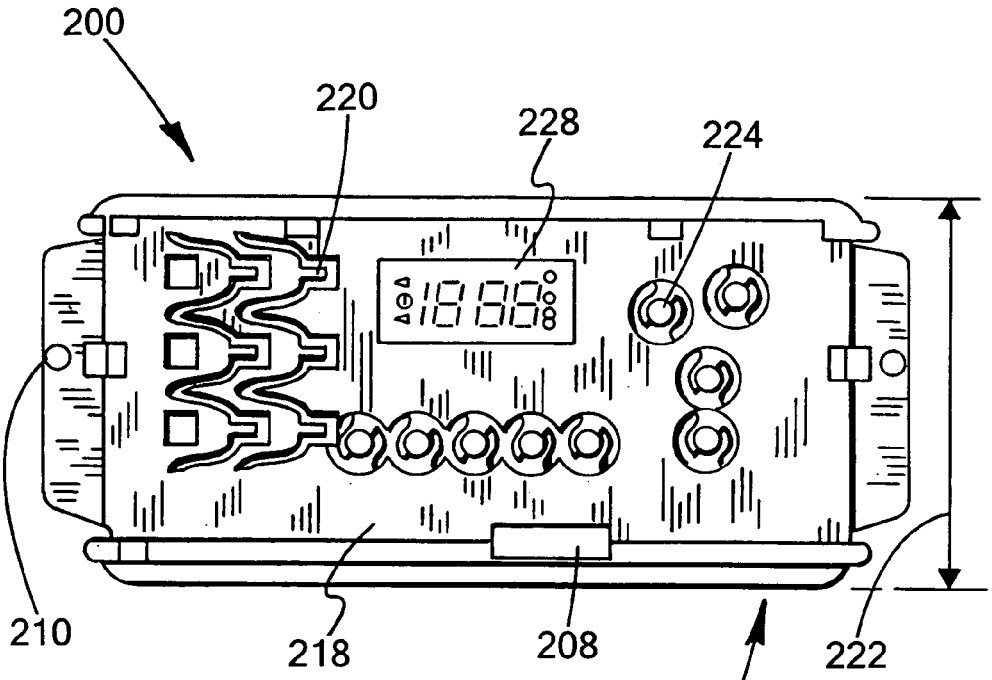
Fig.3. Prior Art
FIG. 3 depicts a top plan view of the standard tactile switch assembly 200 of the prior art in use on a standard circuit board 230 suitable for use with an appliance (not shown).
Figure 4:
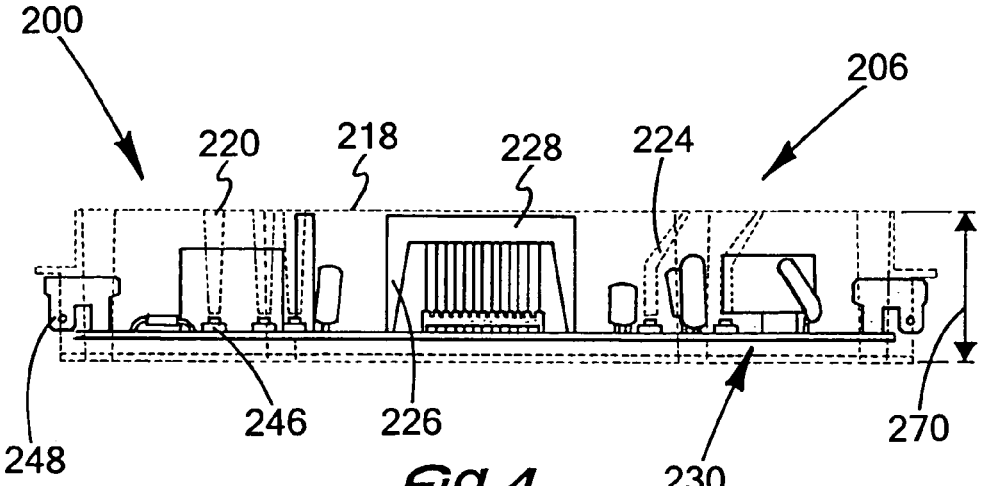
Fig.4. Prior Art
FIG. 4 depicts a side view of the standard tactile switch assembly 200 of the prior art in use on a prior art standard circuit board 230 suitable for use with an appliance (not shown).

Adding FIG. 3 and FIG. 4 to the consideration, the prior art is clearly seen. Standard tactile switch assembly 200 has standard tactile switch 246 and standard circuit board 230. Standard housing 206 has standard housing face 218. Single fastener flange 210 cooperates to securely attach standard tactile switch assembly 200 to the appliance (not shown).

Standard housing face 218 has access panel 208 to provide access to the components, terminals and switches mounted on standard circuit board 230. Access panel 208 is necessary to access specific connectors which are mounted on the component side of the printed circuit board 130 and are enclosed. However, access panel 208 only provides a limited amount of access which can be a little as a one inch window.

Also, standard housing face 218 has large LED display 228. Large LED display 228 has LED legs 226 which connect to standard circuit board 230. This connection supports large LED display 228 in an upright fashion and allows it to align with standard housing face 218.

Standard housing face 218 has straight actuator post 220 and bent actuator post 224. Straight actuator post 220 has a straight body and a direct line between standard housing face 218 and standard switch 246. In contrast, bent actuator post 224 has a bent body to accommodate other components attached to the standard circuit board 230. The bent body links standard housing face 218 and standard switch 246. Such a complex structure has less reliability than the structure found in this invention.

In the prior art, the broad width 222 of standard tactile switch assembly 200 is similar to that of reversely mounted tactile switch assembly 100 (FIG. 1). However, the broad depth 270 of standard tactile switch assembly 200 is significantly greater than that of shallow depth 124. This greater broad depth 270 is required to accommodate longer actuator posts 220 and 224.

Figure 5:
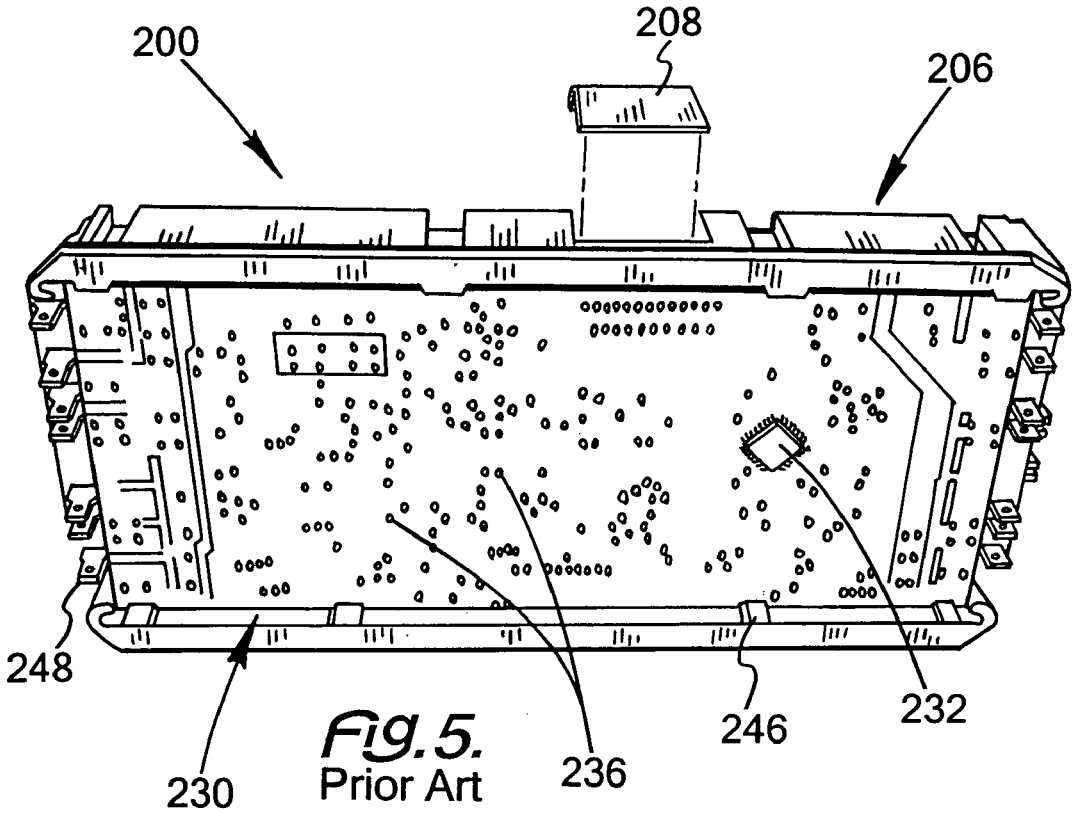
Fig.5. Prior Art
FIG. 5 depicts a bottom perspective view of the standard tactile switch assembly 200 of the prior art in use on a prior art standard circuit board 230 suitable for use with an appliance (not shown).
Figure 6:
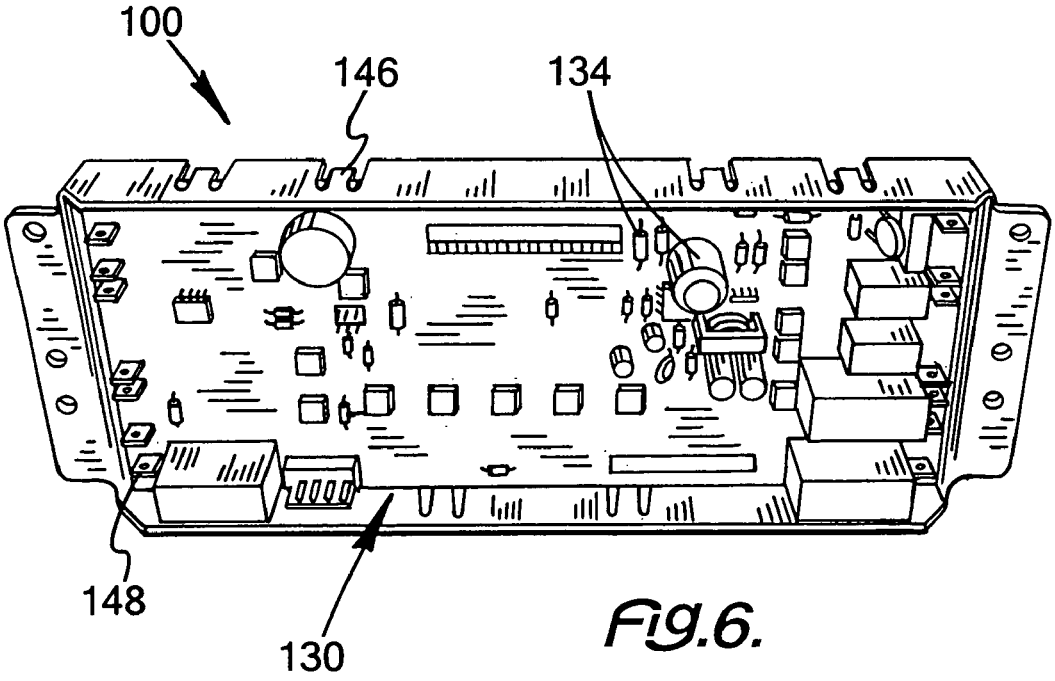
FIG. 6 depicts a bottom perspective view of the reversely mounted tactile switch assembly 100 of this invention in use on a printed circuit board 130 suitable for use with an appliance (not shown).
Figure 7:
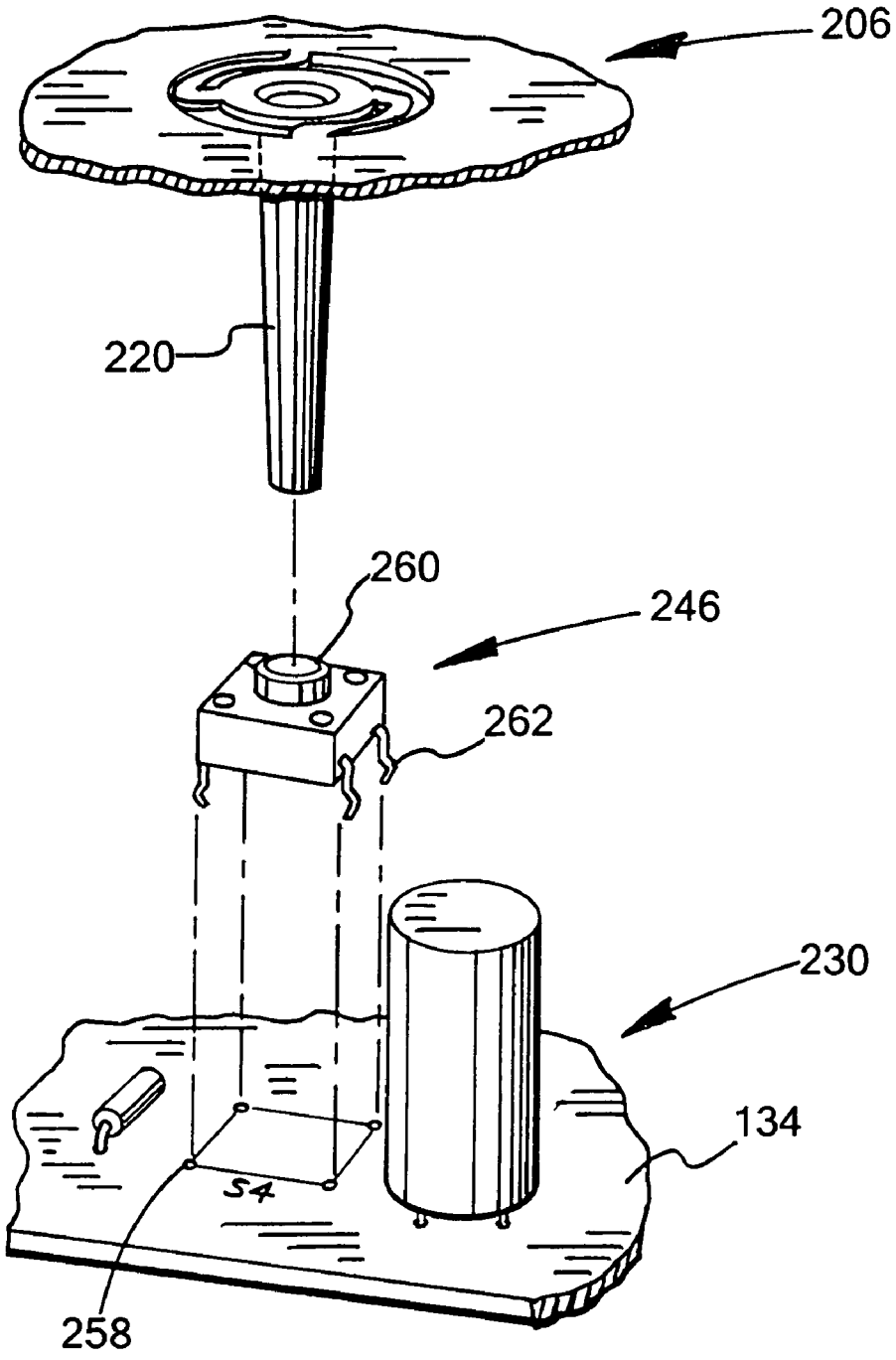
Fig. 7. Prior Art
FIG. 7 depicts a perspective view of the standard tactile switch assembly 200 of the prior art in use on a prior art standard circuit board 230 and isolated therefrom, while being suitable for use with an appliance (not shown).
Figure 8:
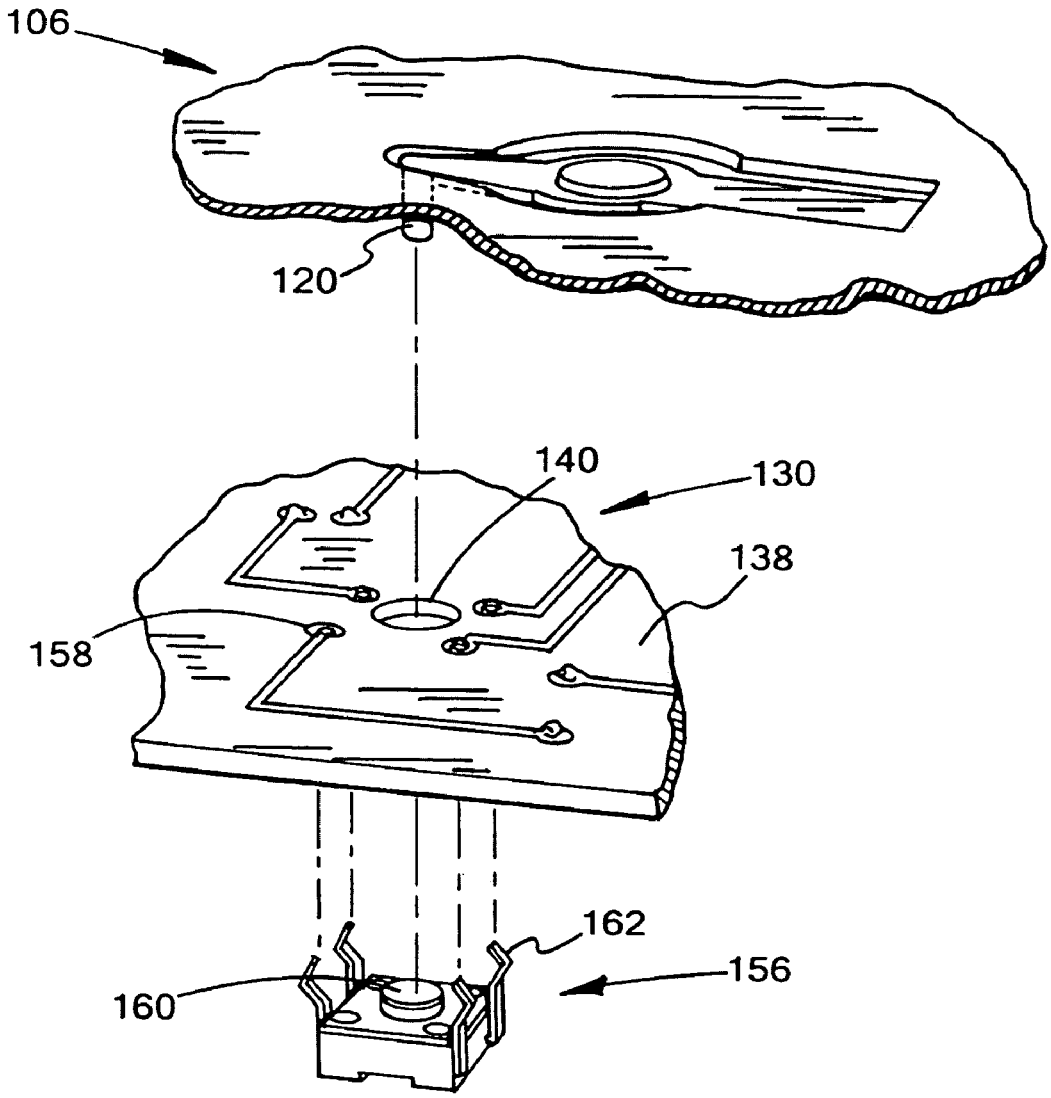
FIG. 8 depicts a perspective view of the reversely mounted tactile switch assembly 100 of this invention in use on a printed circuit board 130 and isolated therefrom.
Figure 9:
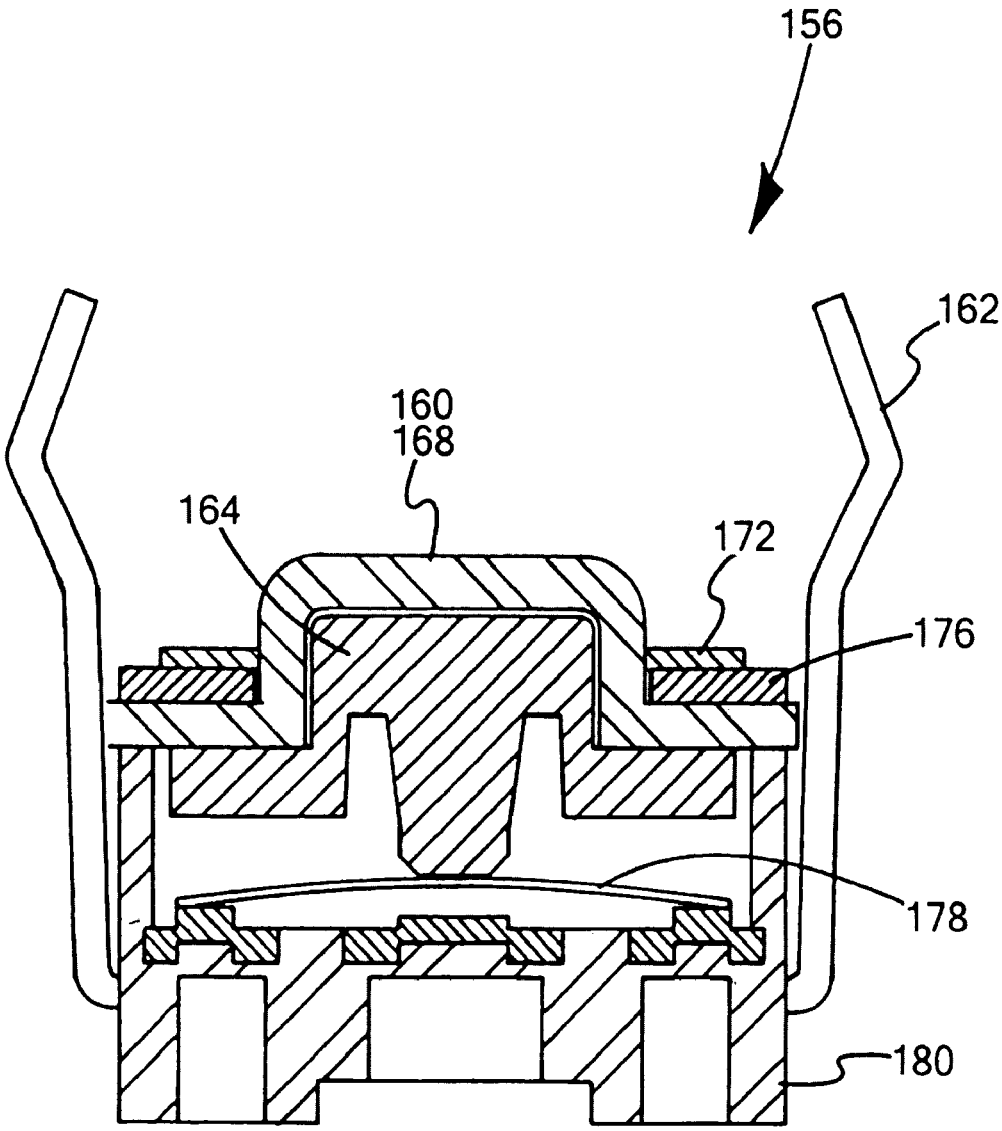
FIG. 9 depicts a side view a side view of the reversely mounted tactile switch assembly 100 of this invention in cross section.
Figure 10:
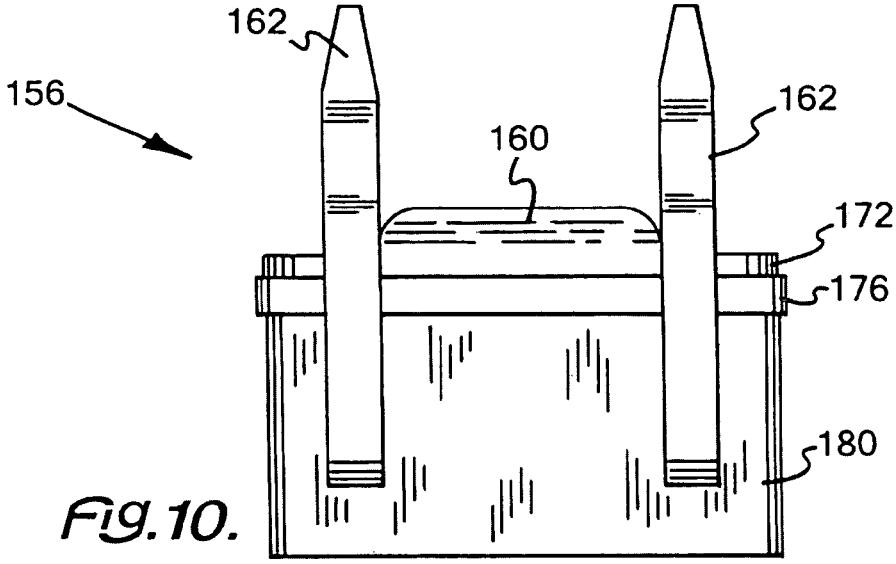
FIG. 10 depicts a side view of the reversely mounted tactile switch assembly 100 of this invention rotated ninety degrees about a vertical axis and based on FIG. 9.
Figure 11:
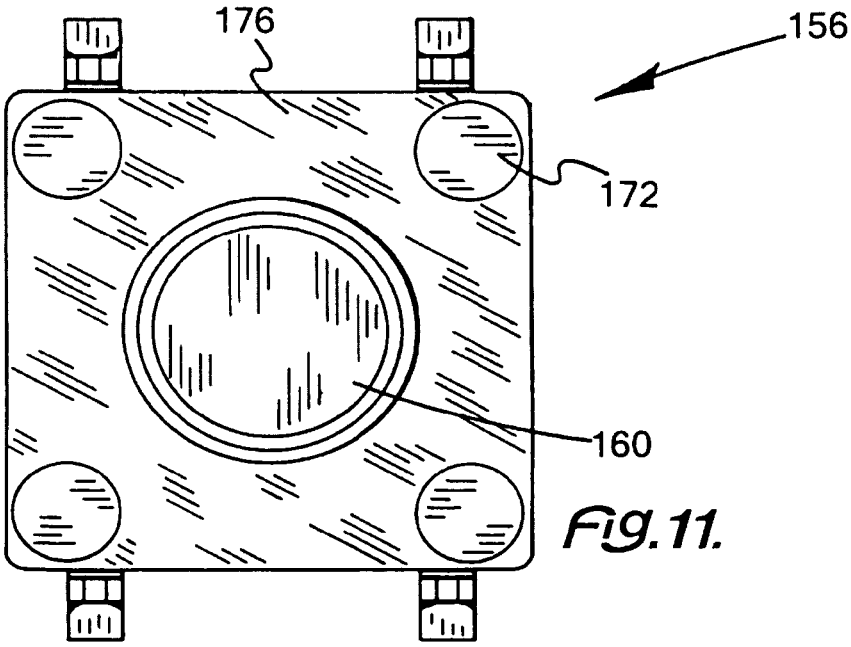
FIG. 11 depicts a top plan view of the reversely mounted tactile switch assembly 100 of this invention based on FIG. 10.
Figure 12:
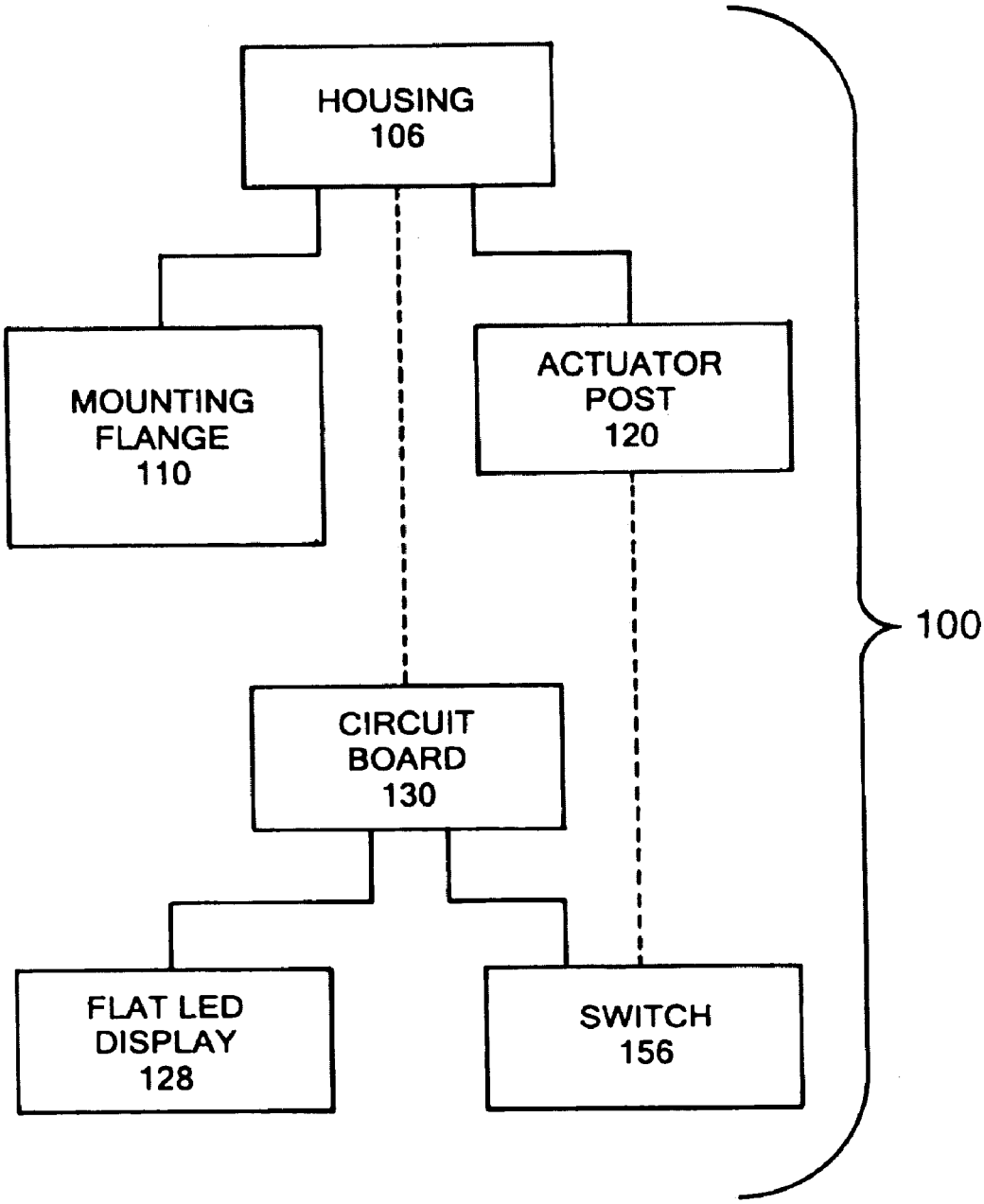
FIG. 12 depicts a block diagram reversely mounted tactile switch assembly 100 of this invention.

Adding FIG. 5 and FIG. 6 to the consideration, the enhancements of reversely mounted tactile switch assembly 100 can be clearly seen. FIG. 5 depicts a back view of the standard tactile switch assembly 200. While FIG. 6, depicts a back view of reversely mounted tactile switch assembly 100. Quick connect terminals 148 and 248 are present in both versions to complete the connection with the appliance (not shown).

In the prior art, the standard circuit board 230 is mounted such that the microchip 232 and the exposed circuits 236 face backwards while the component side 238 faces forward. In contrast, the reversely mounted tactile switch assembly 100 has component side 134 facing backwards.

Moreover, the prior art standard tactile switch assembly 200 has and requires access panel 208 as assembled in use, while the reversely mounted tactile switch assembly 100 neither has nor requires this feature in use, which greatly simplifies the structure. Standard tactile switch assembly 200 has exposed circuits 236 facing backwards toward the backside of the appliance (not shown). Thus, component side 134 is facing forward toward the rear of the appliance (not shown). Since the components are covered by standard housing 206, the access panel 208 provides the only access of the components.

On the other hand, reversely mounted tactile switch assembly 100 has component side 134 facing backwards toward the backside of the appliance (not shown). This positioning allows access to the components, switches, and terminals by removing the appliance cover 202 of the appliance (not shown). With cover 202 removed, the component side 134 is fully exposed for routine maintenance or repair.

On the other hand, reversely mounted tactile switch assembly 100 has component side 134 facing backwards toward the backside of the appliance 102. This positioning allows access to the components, switches, and terminals by removing the appliance cover 202 of the appliance 102. With cover 202 removed, the component side 134 is fully exposed for routine maintenance or repair.

By considering FIG. 7, FIG. 8, FIG. 9, FIG. 10, FIG. 11, the advantages of reversely mounted tactile switch assembly 100 become more clear when considering the prior art structure and especially standard tactile switch assembly 200 herein.

Standard tactile switch assembly 200 utilizes a standard switch 246 which attaches to the component side 134 of standard circuit board 230. Standard circuit board 230 has standard terminal apertures 258. Standard switch 246 has standard housing 206 and standard switch terminal 262 mounted thereon and standard actuator button 260 mounted on an opposing side thereof. Standard switch terminals 262 align and cooperate with standard terminal apertures 258 to secure the standard switch to the standard circuit board 230.

Standard switch 246 has standard actuator button 260. As standard actuator button 260 is pushed, it closes the circuit between standard connection 242 thereby setting instruction to standard switch terminals 262 and the standard circuit board 230.

The user applies pressure to standard housing 206. Under standard housing 206 is straight actuator post 220 (as depicted) or bent actuator post 224. Standard housing 206 is separated from standard actuator button 260 by the length of the actuator post 220 or 224. Straight actuator post 220 reaches from the top of the standard housing 206 to the standard actuator button 260. The pressure applied to standard housing 206 is transferred to the standard actuator button 260 by the straight actuator post 220. Over the course of time, straight actuator post 220 loses its effective contact with standard actuator button 260, and render the device difficult or impossible or operate.

In contrast, reversely mounted tactile switch assembly 100 utilizes a switch 156 in switch assembly 100, which attaches to the component side 134 of printed circuit board 130. Switch 156 includes a switch housing 142, with switch terminals 162 and an actuator button 160. Fastener 172 protrudes from the cover 176 and securely fastens the switch housing 142 together. Secured to one side of the switch housing 142 are the switch terminals 162, which provide electrical connection to the desired circuit or printed circuit board 130. Also on the switch housing 142, and on the same side as the switch terminals 162, is the actuator button 160.

Printed circuit board 130 has switch terminal apertures 158. Switch 156 mounts backward facing onto printed circuit board 130. Switch terminals 162 align and cooperate with switch terminal apertures 158 to securely mount switch 156 to printed circuit board 130. Printed circuit board 130 has post aperture 140. Post aperture 140 permits access to actuator button 160. Thus, reversely mounted tactile switch assembly 100 keeps the profile of the printed circuit board 130 slender.

More particularly, switch housing 142 contains the contact 178 between switch terminals 162 and actuator button 160. Switch housing 142 has a switch base 180, on which is mounted contact 178. Each of switch terminals 162 includes a stem 164 connecting with contact 178. Over contact 178 is a rubber coating 168 secured thereover by a cover 176. Contact 178 completes the electric circuit switch terminals 162, which are preferably four in number.

This structure permits an efficient attachment and use of the reversely mounted tactile switch assembly 100. Due to more direct contact with the actuator button 160, the printed circuit board 130 is used more efficiently. So as actuator button 160 is pushed, it closes the circuit between contact 178, thereby sending instruction to switch terminals 162 and the printed circuit board 130.

This structure permits an efficient attachment and use of the reversely mounted tactile switch assembly 100. Due to more direct contact with the actuator button 160, the printed circuit board 130 is used more efficiently. So as actuator button 160 is pushed, it closes the circuit between contact 178, thereby sending instruction to switch terminals 162 and the printed circuit board 130.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this tool can become clear to a person having ordinary skill in this particular art. Such modifications are clearly covered by this disclosure.

What is claimed and sought to be protected by Letters Patent is:

1. A reversely mountable tactile switch assembly for a printed circuit board comprising:

a) a switch housing supporting the tactile switch assembly;

b) the switch housing having at least two switch terminals of the tactile switch assembly extending therefrom in order to provide an electrical connection to a desired circuit on the printed circuit board;

c) the switch housing having an actuator button of the tactile switch assembly between the at least two switch terminals; and d) the at least two switch terminals extending upwardly past the actuator button.

2. The reversely mountable tactile switch assembly of claim 1 further comprising:

a) a switch base for the switch housing supporting the tactile switch assembly;

b) a contact being situated adjacent to the switch base;

c) the contact being connectable to the at least two switch terminals;

d) a stem being positioned to touch the contact;

e) a coating positioning the stem in the housing; and f) a fastener holding the coating on the stem and the stem in the housing.

3. The reversely mountable tactile switch assembly of claim 2 further comprising a rubber layer being positioned between the coating and the fastener.

4. The reversely mountable tactile switch assembly of claim 3 further comprising the at least two switch terminals being four switch terminals.

5. In a printed circuit board having at least one tactile switch assembly, the printed circuit board being usable in an electronic assembly, the improvement comprising:

a) a switch housing supporting the tactile switch assembly;

b) the switch housing having at least two switch terminals, of the tactile switch assembly, extending therefrom in order to provide an electrical connection to a desired circuit;

c) the switch housing having an actuator button of the tactile switch assembly between the at least two switch terminals;

d) the at least two switch terminals extending upwardly past the actuator button e) a switch base for the switch housing supporting the tactile switch;

f) a contact being situated adjacent to the switch base;

g) the contact being connectable to the at least two switch terminals;

h) a stem being positioned to touch the contact;

i) a coating positioning the stem in the housing;

j) a fastener holding the coating on the stem and the stem in the switch housing; and k) a rubber layer being positioned between the coating and the fastener.

6. The printed circuit board of claim 5 further comprising the at least two switch terminals being four switch terminals.

7. A circuit housing for at least one printed circuit board comprising:

a) a mounting flange being secured to the circuit housing for supporting the circuit housing in a desired position;

b) the circuit housing having narrow width and a shallow depth;

c) a printed circuit board secured in the housing with at least one reversely mounted tactile switch assembly mounted thereon;

d) the circuit housing having a housing face;

e) the housing face having a light emitting diode aperture therein to receive a light emitting diode display;

f) a printed circuit board being mounted in the circuit housing;

g) the printed circuit board having a component side and a circuit side; and h) the at least one reversely mounted tactile switch assembly being accessed from the circuit side.

8. The circuit housing of claim 7 further comprising:

a) the circuit housing having a snap fitting to support the printed circuit board within the circuit housing; and b) the circuit housing having actuator posts to contact the reversely mounted tactile switch assembly as used on an appliance to provide a narrow width and a shallow depth for the circuit housing.

9. The circuit housing of claim 7 further comprising a rubber layer being positioned between the coating and the fastener.

10. The circuit housing of claim 9 further comprising the at least two switch terminals being four switch terminals.

* * * * *